US011199027B2

(12) United States Patent
Rampen

(10) Patent No.: US 11,199,027 B2
(45) Date of Patent: Dec. 14, 2021

(54) LOCKING DEVICE

(71) Applicant: Edmond Rampen, Oakville (CA)

(72) Inventor: Edmond Rampen, Oakville (CA)

( * ) Notice: Subject to any disclaimer, the term of this patent is extended or adjusted under 35 U.S.C. 154(b) by 1059 days.

(21) Appl. No.: 15/807,794

(22) Filed: Nov. 9, 2017

(65) Prior Publication Data

US 2018/0128018 A1 May 10, 2018

Related U.S. Application Data

(60) Provisional application No. 62/420,031, filed on Nov. 10, 2016.

(51) Int. Cl.

| | |
|---|---|
| ***E05B 63/12*** | (2006.01) |
| ***E05C 1/10*** | (2006.01) |
| ***E05C 19/06*** | (2006.01) |
| *E05B 15/04* | (2006.01) |
| *E05B 65/46* | (2017.01) |

(52) U.S. Cl.

CPC ..... *E05B 63/128* (2013.01); *E05C 1/10* (2013.01); *E05C 19/06* (2013.01); *E05B 65/46* (2013.01); *E05B 2015/0475* (2013.01)

(58) Field of Classification Search

CPC ..... E05B 79/04; E05B 79/08; E05B 79/20; E05B 83/36; E05B 81/16; E05B 85/02; E05B 85/08; E05B 77/28; B60J 5/0416; B60R 13/0206; B60R 13/0243

See application file for complete search history.

(56) References Cited

U.S. PATENT DOCUMENTS

| | | | | |
|---|---|---|---|---|
| D242,596 | S | 12/1976 | Munson | |
| D299,486 | S | 1/1989 | Takimoto | |
| D299,487 | S | 1/1989 | Takimoto | |
| 4,818,502 | A | 4/1989 | Taschner | |
| D302,937 | S | 8/1989 | Briggs | |
| 4,915,913 | A | 4/1990 | Williams et al. | |
| 4,920,771 | A | 5/1990 | Jiang | |
| D324,637 | S | 3/1992 | Nicholoulias | |
| 5,095,592 | A * | 3/1992 | Doerfling | F16B 2/241 24/293 |
| D326,402 | S | 5/1992 | Nicholoulias | |
| D344,442 | S | 2/1994 | Myers | |
| D344,668 | S | 3/1994 | Nicholoulias | |

(Continued)

*Primary Examiner* — Kristina R Fulton
*Assistant Examiner* — Thomas L Neubauer
(74) *Attorney, Agent, or Firm* — Westman, Champlin & Koehler, P. A.

(57) ABSTRACT

A locking device for securing a first structure to a second structure. The locking device comprises a housing securable to the first structure, a lock base securable to the second structure, and a locking tab slidably received within said housing. The locking tab has an extended position where a second end is slidably received within the lock base. The lock base has a flexibly resilient locking arm. When in its locked configuration the locking arm releasably engaged with the second end of the locking tab to prevent retraction of the tab from the lock base. The lock base has a resilient member biasing the locking arm to its locked configuration. The lock base has a flexibly resilient removable key member. When engaged with the lock base, a compressive force applied to the key member causes movement of the locking arm from its locked to its unlocked configuration.

12 Claims, 2 Drawing Sheets

(56) References Cited

U.S. PATENT DOCUMENTS

| | | | | |
|---|---|---|---|---|
| D349,446 | S | 8/1994 | Brunette | |
| 5,351,509 | A | 10/1994 | Visenzi | |
| D351,984 | S | 11/1994 | Victor | |
| D371,203 | S | 6/1996 | Deeds | |
| D419,425 | S | 1/2000 | Clark et al. | |
| D458,578 | S | 6/2002 | Hrysko | |
| 6,418,760 | B1 | 7/2002 | Fettes | |
| 6,547,293 | B1 | 4/2003 | Cheng | |
| D481,614 | S | 11/2003 | Onel | |
| D489,595 | S | 5/2004 | Gleichauf et al. | |
| D491,441 | S | 6/2004 | Sato et al. | |
| 6,834,896 | B2 | 12/2004 | Smith | |
| 6,871,517 | B2 * | 3/2005 | Bonelli | A44B 11/266 24/166 |
| 7,044,512 | B1 | 5/2006 | Moreno | |
| D548,044 | S | 8/2007 | Tang | |
| 7,380,846 | B1 | 6/2008 | Moreno | |
| 7,712,343 | B2 * | 5/2010 | Smith | E05B 13/004 70/467 |
| D617,626 | S | 6/2010 | David | |
| 8,056,945 | B2 | 11/2011 | Moreno | |
| D727,734 | S | 4/2015 | Kwak et al. | |
| 9,175,913 | B2 | 11/2015 | Cupps et al. | |
| 9,341,002 | B2 | 5/2016 | Kongshammer | |
| D763,659 | S | 8/2016 | Tung | |
| D775,509 | S | 1/2017 | Marsden | |
| D780,554 | S | 3/2017 | Marsden | |
| D789,176 | S | 6/2017 | Bruce | |
| D836,419 | S | 12/2018 | Marsden | |
| D890,596 | S | 7/2020 | Piggott | |
| D899,891 | S | 10/2020 | Xie | |
| D915,178 | S | 4/2021 | Tien | |

* cited by examiner

LOCKING DEVICE

CROSS-REFERENCE TO RELATED APPLICATION(S)

This application claims priority to U.S. Provisional Patent Application Ser. No. 62/420,031, filed Nov. 10, 2016, which is hereby incorporated by reference in its entirety.

FIELD

This disclosure relates generally to locks and locking devices.

BACKGROUND

At present, many different types of locks and locking devices are used for preventing, restricting or limiting access to confined areas, spaces or devices, or for securing together two objects, surfaces or structures. At times, locking devices may be used to prevent or limit access to the interiors of household appliances or cabinets. Such devices can be used to prevent or restrict the opening of the doors or drawers of the appliance or cabinet.

SUMMARY

In various aspects the invention provides a locking device that may be used to secure together first and second structures, such as a door or drawer and a cabinet to which the door or drawer is attached.

In one aspect the invention provides locking device for securing a first structure to a second structure, the locking device comprising a housing securable to the first structure; a lock base securable to the second structure; a locking tab slidably received within said housing, said locking tab having a first end retained within said housing and a second end extending outwardly from said housing, said locking tab having an extended position wherein said second end is slidably received within said lock base, and having a retracted position wherein said second end is disengaged from said lock base, said lock base including a flexibly resilient locking arm, said locking arm having a locked and an unlocked configuration, when in said locked configuration, said locking arm releasably engaged with said second end of said locking tab when said locking tab is in said extended position thereby preventing movement of said locking tab from said extended to said retracted position, when said locking arm in said unlocked configuration said locking tab slidably retractable from said lock base, said lock base including a resilient member biasing said locking arm to said locked configuration, said lock base further including a flexibly resilient removable key member engagable and disengagable with said lock base, when engaged with said lock base a compressive force applied to said key member causes movement of said locking arm from said locked to said unlocked configuration, when said locking arm engaged with said second end of said locking tab and said key member disengaged from said lock base, said resilient member maintaining said locking arm in said locked configuration to prevent movement of said locking tab from said extended to said retracted position.

In another aspect there is provided a locking device for securing a first structure to a second structure, the locking device comprising a housing securable to the first structure; a lock base securable to the second structure; a locking tab slidably received within said housing, said locking tab having a first end retained within said housing and a second end extending outwardly from said housing, said locking tab having an extended position wherein said second end is slidably received within said lock base, and having a retracted position wherein said second end is disengaged from said lock base, said lock base including a flexibly resilient locking arm having a locking head, said locking arm having a locked and an unlocked configuration, said second end of said locking tab including an opening into which said locking head on said locking arm is received when said locking tab is in said extended position and said locking arm is in said locked configuration, the receipt of said locking head within said opening preventing movement of said locking tab from said extended to said retracted position, said lock base including a resilient member biasing said locking arm to said locked configuration, said lock base further including a flexibly resilient removable key member engagable and disengagable with said lock base, when engaged with said lock base a compressive force applied to said key member causes movement of said locking arm from said locked to said unlocked configuration, when said locking arm engaged with said second end of said locking tab and said key member disengaged from said lock base, said resilient member maintaining said locking arm in said locked configuration to prevent movement of said locking tab from said extended to said retracted position.

BRIEF DESCRIPTION OF THE DRAWINGS

Reference will now be made, by way of example, to the accompanying drawings which show example embodiments of the present application, and in which.

DESCRIPTION

In various examples, the present disclosure describes devices and methods for locking the doors of household appliances. It will, however, be appreciated that the disclosed methods and devices may also be suitable for use in association with other doors, drawers, openings, and structures, with modification as appropriate.

Figure 1:
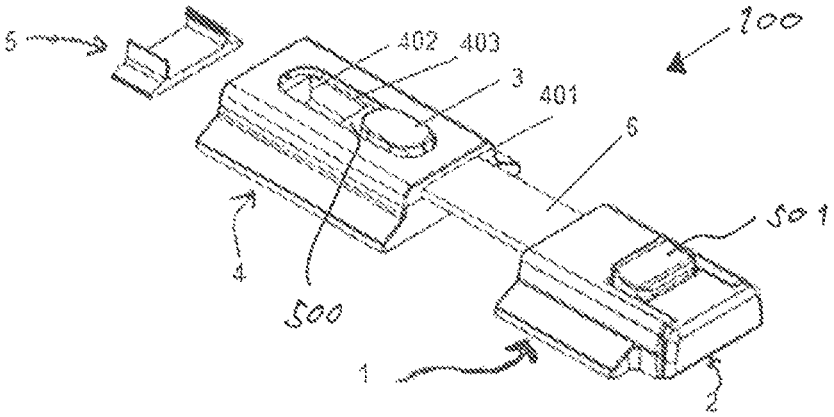
FIG. 1 is a perspective view of one embodiment of the locking device.
Figure 2:
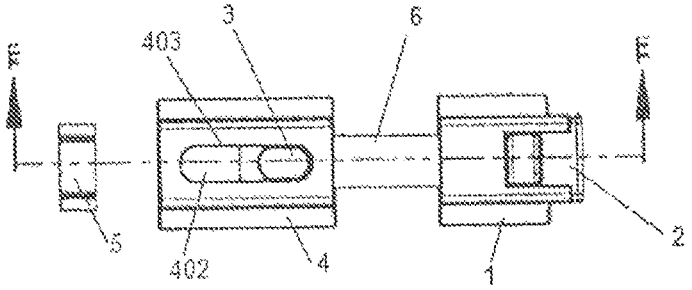
FIG. 2 is a plan view of the locking device of FIG. 1.
Figure 3:
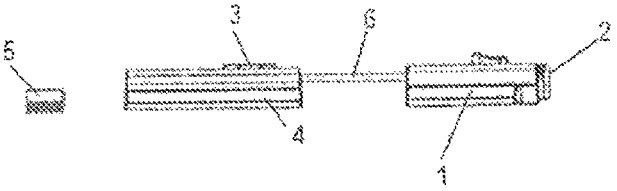
FIG. 3 is a side view of the locking device of FIG. 1.

FIGS. 1-3 are perspective, plan, and side views of the locking device of one embodiment of the invention.

The locking device of the current invention is referenced generally by reference numeral 100 and has an engaged or a locked configuration, and a disengaged or unlocked configuration. The locking device includes a lock base 1, which may accommodate a key member 2 therein. The key 2 is engagable and disengagable with lock base 1 so that it may be removed from the lock base. A portion of the key may protrude from the lock base 1 to facilitate both use of the device and removal of the key 2 from the lock base 1. There is optionally provided a key keeper 5 for holding the key 2 when it is removed from the lock base 1.

Locking device 100 also comprises a sliding tab base 4, which is generally in the form of a housing 402 having an opening or slot 403. A locking tab 6 is provided. Locking tab 6 has a first end 500 slidably retained within the housing 402 and a second end 501 extending longitudinally through an opening 401 to the outside of housing 402. Locking tab 6 is preferably slidable longitudinally so that its length extending outside of housing 402 may be changed. The opening 401 may also serve as a guide for the sliding movement of locking tab 6.

A button or handle 3 may be provided to facilitate sliding locking tab 6. The button 3 may protrude out of the opening 403 so that a user can easily push/pull the button to move the tab 6 lengthwise relative to housing 402. It is to be understood that the button 3 and locking tab 6 may be any suitable structure made by any suitable means known in the field. In some embodiments, the button 3 may be made integrally with locking tab 6. Alternatively, the button 3 may be a component made separately from the tab 6 that engages the tab 6 when the device is assembled.

The bottom of housing 402 and the lock base 1 may be provided with attachment means so that they can be secured to first and second structures. Before use, typically one of housing 402 and lock base 1 is attached to a first structure (which may be a part of a door or drawer) and the other of housing 402 and lock base 1 is attached to a second structure (which may be a corresponding cabinet or frame for the door or drawer). In one embodiment housing 402 and lock base 1 are provided with high bond adhesive tapes on their bottom surfaces to secure them in place. Other forms of securement are possible. Where the locking device is used on a household appliance, one of housing 402 and lock base 1 will typically be fixed to the appliance and the other fixed to the appliance door.

Figure 4:
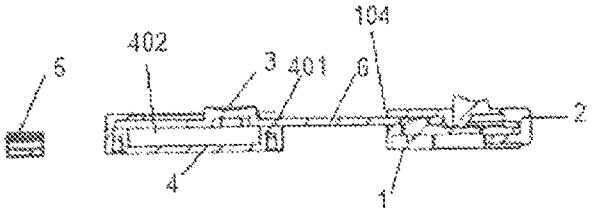
FIG. 4 is a sectional view along the line E-E of FIG. 1.

FIG. 4 is a sectional view of the device.

Locking tab 6 has a retracted position and an extended position. When in its extended position, second end 501 is slidably received within lock base 1 through an opening 104, at which point it engages a flexibly resilient locking arm 204 to form a locking relationship or a locked configuration. When housing 402 and lock base 1 are fixed to the first and second structures, opening 104 is preferably aligned with opening 401 to assist in guiding the sliding movement of the tab 6. When locking tab 6 is in its retracted position, second end 501 is withdrawn and disengaged from lock base 1.

Figure 5:
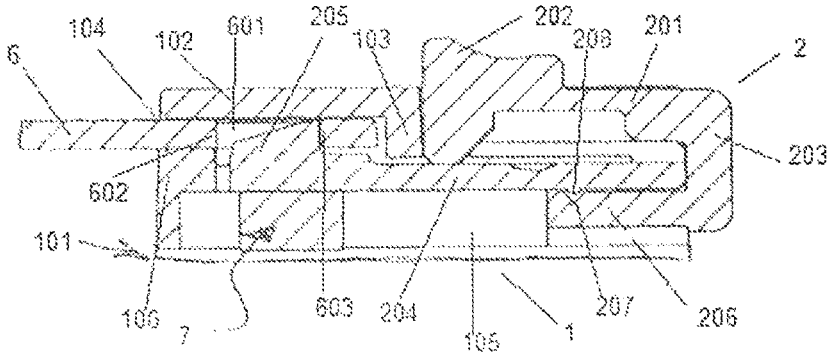
FIG. 5 is a sectional view similar to FIG. 4 wherein the locking device is in a locked position.

FIG. 5 is a detailed sectional view of the lock base 1 when the device is in a locked position.

Lock base 1 has an internal cavity 105 wherein the key 2 may be at least partially releasably accommodated. A flexibly resilient member or compressible elastic structure 7 is provided within the cavity. The resiliency of structure 7 may be changed, for example, by altering its dimensions, density and/or structure. Typically, structure 7 would comprise resiliently compressible foam or a spring.

Locking tab 6 enters the cavity 105 through the opening 104. It will be understood that the opening 104 may be formed by any suitable means known in the field. In some embodiments, opening 104 is formed by a substantially vertical lower structure 106 and a substantially planar upper structure 102 that terminate to form opening 104. Structure 102 may have a downward extension 103 positioned at its end opposite opening 104.

Key 2 comprises an upper flexibly resilient arm 201 and a lower arm 206 connected by a bridge portion 203. In their rest positions, arms 201 and 206 are preferably generally parallel to each other. In preferred embodiments, upper arm 201 includes an enlarged portion or knob 202 positioned at or near the outer end of arm 201, distal from the bridge portion 203. In some embodiments, upper arm 201, lower arm 206 and bridge portion 203 of the key 2 may be formed in one piece. In other embodiments the three components may be constructed separately and later joined or otherwise fastened together to form key 2.

Locking arm 204 is positioned within cavity 105. Locking arm 204 includes an elongate, substantially planar and flexibly resilient, portion 250, and an enlarged end or locking head 205. The substantially planar portion 250 lies at least partially adjacent to lower arm 206 when key 2 is engaged within lock base 1. Locking head 205 is preferably located at or near the outer end of the locking arm 204, distal to lower arm 206. As will be discussed in greater detail, when locking tab 6 is received within cavity 105 locking head 205 is positioned so as to be at least partially releasably receivable within a recess or opening 601 in second end 501 of locking tab 6.

In some embodiments, when key 2 is received within locking base 1 locking arm 204 may be releasably secured or otherwise mechanically connected to lower arm 206 to prevent or limit longitudinal sliding movement of the locking arm within lock base 1. From a thorough understanding of the invention it will also be appreciated that securing or otherwise binding lower arm 206 to locking arm 204 will further serve to help retain key 2 within lock base 1, and will also limit or prevent vertical deflection of the end of locking arm 204 that contacts lower arm 206. In other embodiments, locking arm 204 may be integral with or otherwise directly connected or secured to lock base 1.

In the embodiment shown in the attached drawings, a recess or detent 207 may be located on the upper surface of lower arm 206. Recess 207 may be configured to receive a protrusion 208 within lock base 1 (in the attached drawings protrusion 208 is shown as positioned on the lower surface of locking arm 204), such that key 2 may be releasably secured within lock base 1 through the engagement of protrusion 208 within detent 207. Many other means and mechanisms for securing key 2 in place could be used, including a relative reversal of the positions of detent 207 and protrusion 208.

In preferred embodiments, enlarged portion or knob 202 extends upwardly relative to the upper surface of upper arm 201 to provide a structure suitable to be pushed upon by the finger or thumb of a user. Enlarged portion or knob 202 extends downwardly relative to the lower surface of upper arm 201 and into cavity 105 so that the lower surface of the enlarged portion or knob 202 is close to or in contact with the upper surface of locking arm 204, and capable of exerting a compressive force to move the locking arm from its locked to its unlocked configuration.

As shown in FIG. 5, locking arm 204 is configured such that when received within cavity 105 it extends to a position such that locking head 205 is generally above and supported by resilient member or structure 7. It will be noted that structure 7 will seek to retain locking head 205 in a position where flexibly resilient portion 250 is generally parallel to upper structure 102 of lock base 1.

As also shown in the attached drawings, and as discussed above, in one embodiment locking tab 6 has a recess or opening 601 configured in second end 501. Recess or opening 601 includes forward and rearward edges 603 and 602, respectively. As mentioned, the locking device in accordance with the invention has an engaged (or locked) configuration and a disengaged (or unlocked) configuration. When in its engaged configuration, with tab 6 inserted into cavity 105 through opening 104, locking head 205 engages, or is received at least partially within, recess or opening 601 so that locking tab 6 is retained within cavity 105 through an interference between locking head 205 and forward edge 603. That is, the receipt of locking head 205 at least partially into recess or opening 601 causes forward edge 603 to contact locking head 205 if an attempt to retract locking tab 6 from within cavity 5 is made, thereby securing or "locking" tab 6 in place.

Figure 6:
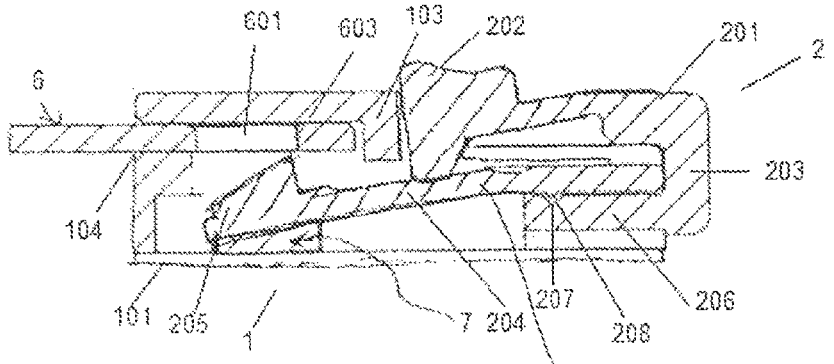
FIG. 6 is a sectional view similar to FIG. 5 wherein the locking device is in an unlocked position.

Structure 7 may be constructed so as to not only support locking head portion 205, but to also forcefully bias it or push it upwardly into recess or opening 601, thereby biasing locking arm 204 to its locked configuration. In the case where opening 601 extends completely through tab 6 (as shown in FIGS. 5 and 6) at least a portion of the locking head may extend through opening 601 and contact the underside of planar upper structure 102 (see FIG. 5). That is, structure 7 may effectively be oversized in height so that it drives locking head 205 upwardly into contact with the underside of structure 102 (which is effectively the roof of the locking area) to enhance the retaining of locking tab 6 within lock base 1.

In some embodiments, locking head 205 is formed with a slanted top or upper surface that is inclined in a direction away from housing 402. When the locking device is in its disengaged configuration with locking tab 6 retracted from cavity 105, pushing tab 6 into the cavity will cause the front of the tab to be engaged against the slanted upper surface of the locking head, effectively driving the locking head downwardly, moving locking arm 204 from its locked configuration to its unlocked configuration, and permitting locking tab 6 to be further received within cavity 105. After forward edge 603 passes the inner end of locking head 205 the resiliency of structure 7 will push the locking head upwardly into recess or opening 601 to its locked configuration to form a locking relationship between the locking arm and locking tab 6. It is understood that recess or opening 601 and locking head 205 may be formed in any suitable corresponding shapes and sizes known in the field to ensure a locking relationship.

With reference to FIG. 6, in order to release the locking relationship between locking arm 204 and locking tab 6, the user pushes down on knob 202, which in turn pushes downwardly on locking arm 204. The application of a downward force to locking arm 204, by the downward movement of knob 202, sufficient to counteract the biasing force of resilient member or structure 7 will cause locking head 205 to be moved downwardly from its locked to its unlocked configuration. When the locking head is moved entirely out of recess or opening 601, there will no longer be interference between locking head 205 and the forward edge 603, permitting locking tab 6 to be withdrawn backwardly through opening 104. After the locking tab 6 exits locking base 1 through opening 104, the locking device is disengaged or "unlocked".

The amount of force required to be applied to knob 202 in order to deflect locking head 205 downwardly will depend on the configuration and resiliency of structure 7, the resiliency of locking arm 204, and the resiliency of upper arm 201. The "lock holding strength" can thus be controlled by increasing or decreasing the amount of compression applied by structure 7 to locking head 205. The amount of compression required to permit the locking head to be disengaged from opening 601 can be a function of one or more of the material from which structure 7 is constructed, the physical dimension (primarily height) of structure 7, and the physical configuration of structure 7 (i.e. is it in the form of a block or cube, in the form of helical or other spring, in the form of a Belleville washer, etc.).

In one embodiment, the inner end of locking head 205 may be configured so that the interference between the forward edge 603 and the locking head 205 prevents tab 6 from being released from the cavity without moving locking head 205 entirely out of recess or opening 601.

In accordance with an embodiment of the invention, key 2 may be removed from the lock base 1 to prevent an unauthorized movement of locking arm 204 from its locked to its unlocked configuration and an unauthorized disengagement or "unlocking" of the locking device. Removing key 2 requires a user to grasp the key (in most instances by grasping upper and lower arms 201 and 206 between the user's thumb and index finger) and pulling outwardly from lock base 1 in a direction generally parallel to upper surface or upper structure 102. A force sufficient to displace protrusion 208 from recess or detent 207 (or to otherwise overcome the mechanical bonding or connection between locking arm 204 and lower arm 206) will be required to remove the key. Once removed, the key may be held in the key keeper 5.

With the locking device in its engaged position or locked configuration, and with locking tab 6 secured within cavity 105 through the engagement of locking head 205 with recess or opening 601, the removal of key 2 from lock base 1 will prevent or limit an unauthorized disengagement or "unlocking" of the device. That is, it will be appreciated that with key 2 removed from lock base 1, structure 7 will continue to retain the engagement of locking head 205 within recess or opening 601, but there will no longer be presented the means by which locking arm 204 can be deflected downwardly to remove locking head 205 from within opening 601. Not until key 2 is returned to its position within locking base 1, as described above, will knob 202 enable a user to deflect locking arm 204 downwardly and to thereby disengage locking head 205 and permit the withdraw of locking tab 6 from cavity 105. It will be appreciated that resilient member or structure 7 enhances the upward force applied to locking head 205 and serves to help retain the locking head within recess or opening 601 (and hence the locking device in its locked configuration) when key 2 is removed.

A method of using the locking device is also provided.

In an embodiment, the device is attached to a door structure of a household appliance or other object or device. For example, housing 402 may be fixed to the stationary part of the door structure, while the lock base 1 is fixed to the movable part of the door structure. Preferably, the device is fixed to the door structure when the device is in a locked or engaged configuration so that the alignment of the sliding tab base 4 and the lock base 1 may be simplified.

Once the device is fixed to the door structure, a user may release the locking relationship by pressing on knob 202 and sliding locking tab 6 as described above. Once locking tab 6 is slid entirely out of lock base 1, the locking device is disengaged and no longer prevents the door from being opened. When the user intends to lock the door using the locking device, the user simply closes the door and slides locking tab 6 into the lock base 1 so that a locking relationship forms between locking tab 6 and locking head 205.

The described locking device may be used on various household appliances, including but not limited to stoves, ovens, refrigerators, freezers, trunks, boxes and cupboard doors. A wide variety of other applications are also contemplated.

The embodiments of the present disclosure described above are intended to be examples only. The present disclosure may be embodied in other specific forms. Alterations, modifications and variations to the disclosure may be made. While the system, devices and processes disclosed and shown herein may comprise a specific number of elements/components, the systems, devices and assemblies could be modified to include addition or fewer of such elements/components. For example, while any of the elements/components disclosed may be referenced as being singular, the embodiments disclosed herein could be modified to include a plurality of such elements/components. Selected features from one or more of the above-described embodiments may be combined to create alternative embodiments not explicitly described. The subject matter described herein intends to cover and embrace all suitable changes in technology.

The invention claimed is:

1. A locking device for securing a first structure to a second structure, the locking device comprising:

a housing securable to the first structure;

a lock base securable to the second structure; and a locking tab slidably received within said housing, said locking tab having a first end retained within said housing and a second end extending outwardly from said housing, said locking tab having an extended position wherein said second end is slidably received within said lock base, and having a retracted position wherein said second end is disengaged from said lock base, said lock base including a flexibly resilient locking arm, said locking arm having a locked and an unlocked configuration, when in said locked configuration, said locking arm releasably engaged with said second end of said locking tab when said locking tab is in said extended position thereby preventing movement of said locking tab from said extended to said retracted position, when said locking arm in said unlocked configuration said locking tab slidably retractable from said lock base, said lock base including a resilient member biasing said locking arm to said locked configuration, said lock base further including a flexibly resilient removable key member engagable and disengagable with said lock base, when engaged with said lock base a compressive force applied to said key member causes movement of a resilient arm on said key member in a direction toward said locking arm, wherein engagement of said resilient arm of said key member with said locking arm causes movement of said locking arm from said locked to said unlocked configuration, when said locking arm engaged with said second end of said locking tab and said key member disengageable from said lock base and said resilient member maintaining said locking arm in said locked configuration to prevent movement of said locking tab from said extended to said retracted position.

2. The locking device as claimed in claim 1 wherein said locking tab includes a button or handle to facilitate movement of said locking tab between said extended and said retracted positions.

3. The locking device as claimed in claim 2 wherein said key member includes an enlarged portion or knob to facilitate the application of said compressive force to move said locking arm from said locked to said unlocked configuration.

4. The locking device as claimed in claim 1 wherein said second end of said locking tab includes an opening into which a locking head on said locking arm is received when said locking tab is in said extended position and said locking arm is in said locked configuration, the receipt of said locking head within said opening preventing movement of said locking tab from said extended to said retracted position.

5. The locking device as claimed in claim 1 wherein said resilient member comprises resiliently compressible foam.

6. The locking device as claimed in claim 5 wherein one of said key member and said lock base includes a detent and the other of said key member and said lock base includes a protrusion, the receipt of said protrusion within said detent releasably securing said key member to said lock base.

7. The locking device as claimed in claim 6 wherein said locking head has a sloped upper surface that is inclined in a direction away from said housing such that the receipt of said second end of said locking tab within said lock base as said locking tab is moved from said retracted to said extended position causes said second end of said locking tab to engage said sloped upper surface of said locking head resulting in movement of said locking arm from said locked configuration to said unlocked configuration, when said locking tab in said extended position said second end disengaging said sloped upper surface of said locking head with said locking head becoming aligned with said opening permitting said resilient member to return said locking arm to said locked configuration.

8. The locking device as claimed in claim 1 wherein said key member directly engages with said locking arm, through direct contact between said resilient arm of said key member, when causing movement of said locking arm from said locked to said unlocked configuration.

9. A locking device for securing a first structure to a second structure, the locking device comprising:

a housing securable to the first structure;

a lock base securable to the second structure; and a locking tab slidably received within said housing, said locking tab having a first end retained within said housing and a second end extending outwardly from said housing, said locking tab having an extended position wherein said second end is slidably received within said lock base, and having a retracted position wherein said second end is disengaged from said lock base, said lock base including a flexibly resilient locking arm having a locking head, said locking arm having a locked and an unlocked configuration, said second end of said locking tab including an opening into which said locking head on said locking arm is received when said locking tab is in said extended position and said locking arm is in said locked configuration, the receipt of said locking head within said opening preventing movement of said locking tab from said extended to said retracted position, said lock base including a resilient member biasing said locking arm to said locked configuration, said lock base further including a flexibly resilient removable key member engagable and disengagable with said lock base, when engaged with said lock base a compressive force applied to said key member causes movement of a resilient arm on said key member in a direction toward said locking arm, wherein engagement of said resilient arm of said key member with said locking arm causes movement of said locking arm from said locked to said unlocked configuration, when said locking arm engaged with said second end of said locking tab and said key member disengageable from said lock base and said resilient member maintaining said locking arm in said locked configuration to prevent movement of said locking tab from said extended to said retracted position.

10. The locking device as claimed in claim 9 wherein said resilient member comprises resiliently compressible foam.

11. The locking device as claimed in claim 10 wherein one of said key member and said lock base includes a detent and the other of said key member and said lock base includes a protrusion, the receipt of said protrusion within said detent releasably securing said key member to said lock base.

12. The locking device as claimed in claim 9 wherein said key member directly engages with said locking arm, through direct contact between said resilient arm of said key member, when causing movement of said locking arm from said locked to said unlocked configuration.

* * * * *